US005225043A

United States Patent [19]

Braun et al.

[11] Patent Number: 5,225,043

[45] Date of Patent: Jul. 6, 1993

[54] TWIN WIRE FORMER WITH WATER GUIDE ELEMENT OVER THE FORMING ZONE

[75] Inventors: Heinz Braun; Alfred Bubnik; Herbert Holik, all of Ravensburg; Rüdiger Kurtz, Immenstaad/B.; Heinz Steckenreuter, Ravensburg; Helmut Stieb, Schlier-Oberankenroute; Jürgen Zenz, Baienfurt, all of Fed. Rep. of Germany

[73] Assignee: Sulzer-Escher Wyss GmbH, Ravensburg, Fed. Rep. of Germany

[21] Appl. No.: 803,714

[22] Filed: Dec. 4, 1991

Related U.S. Application Data

[63] Continuation of Ser. No. 498,088, Mar. 22, 1990, abandoned.

[30] Foreign Application Priority Data

Apr. 4, 1989 [DE] Fed. Rep. of Germany ..... 3910892

[51] Int. Cl.[5] ..... D21F 1/00; D21F 1/36

[52] U.S. Cl. ..... 162/301; 162/300; 162/DIG. 7

[58] Field of Search ..... 162/300, 301, 303, 352, 162/DIG. 7

[56] References Cited

U.S. PATENT DOCUMENTS

| | | | |
|---|---|---|---|
| 3,438,854 | 4/1969 | Means | 162/303 |
| 3,726,758 | 4/1973 | Parker et al. | 162/299 |
| 4,209,360 | 6/1980 | Stenberg et al. | 162/301 |
| 4,523,978 | 6/1985 | Pullinen | 162/352 |
| 4,532,008 | 7/1985 | Creagan et al. | 162/301 |
| 4,609,435 | 9/1986 | Tissari | 162/352 |
| 4,917,766 | 4/1990 | Koivuranta et al. | 162/352 |
| 4,925,531 | 5/1990 | Koski | 162/301 |

*Primary Examiner*—Karen M. Hastings
*Attorney, Agent, or Firm*—Wolf, Greenfield & Sacks

[57] ABSTRACT

A twin screen paper forming apparatus is provided having upper and lower screens moving in a first direction and wrapping around a portion of a leading forming roller positioned at the beginning of a forming zone where the upper and lower screens converge to form a twin screen. At least one stationary forming element is positioned downstream of the leading forming roller to contact with the lower screen. A water guide element is also located in the region of the forming zone approximately at the start of the forming zone. At least one forming rail contacts the upper screen and a pulp suspension discharge nozzle is positioned, to prevent preliminary draining, upstream of the location where the upper and lower screens converge.

27 Claims, 1 Drawing Sheet

TWIN WIRE FORMER WITH WATER GUIDE ELEMENT OVER THE FORMING ZONE

This application is a continuation of application Ser. No. 07/498,088, filed Mar. 22, 1990, now abandoned.

FIELD OF INVENTION

The invention relates to a twin screen paper forming apparatus. In particular, the apparatus includes a twin screen having upper and lower screens and a leading forming roller located at the start of a forming zone. At least one forming element, abutting the lower screen, is disposed downstream of the leading forming roller. A guide element located near the leading forming roller extends downstream approximately from the start of the forming zone. The leading forming roller is partially surrounded by the twin screen and at least one draining rail is provided above the upper screen.

BACKGROUND OF INVENTION

A twin screen paper forming apparatus with preliminary draining is shown in German Patent No. DE-OA-3123132. The leading forming roller is positioned above the upper screen and functions as an open forming roller. Water is driven obliquely upwards, but no driving force for producing secondary water streams in the region of the draining rails is produced since these streams run approximately parallel and have substantially uniform speed. A further forming roller is located below the lower screen downstream of the leading forming roller. Draining rails are located opposite the further forming roller so that they do not contact the upper screen.

Other twin screen paper formers have an upper leading forming roller near the upper screen and draining rails in contact with the leading forming roller. These devices have suction chambers disposed between the draining rails for extracting water laterally from the device.

SUMMARY OF INVENTION

An object of the present invention is to provide a twin screen paper forming apparatus which is simpler and more compact and which achieves gentler and better draining within the forming zone without adversely affecting the fibre retention while improving and, in particular, homogenizing the forming process.

It is another object of this invention to eliminate suction chambers, thus, allowing a higher rate of introduction of pulp suspension and closer staggering of forming rails resulting in more uniform paper texture.

It is another object of this invention to provide draining rails that act as forming rails lying on the upper screen and, in particular, press thereon so that deflection of the twin screen takes place to improve paper texture.

It is yet another object of this invention to provide a vigorous directed driving stream of water to drain the pulp suspension more effectively.

These objects are achieved by providing a curved stationary forming element having a flatter curvature than the leading forming roller. The draining rails act as forming rails which are supported by the upper screen. A pulp suspension supplying nozzle is arranged in front of the point where the upper screen and the lower screen converge to form the twin screen.

As a result, the forming roller produces a stream of water which is easily diverted, thus, eliminating the need for a suction chamber along the water guide element in the end region of the forming zone. The water guide element of the present invention optimally has some degree of curvature, but is relatively flat. The particular construction depends upon the flow conditions, i.e., so as to direct the water approximately parallel to the screen. By optimally aligning and guiding the spun stream of water, a driving stream produces secondary streams in the region of the draining rails. This applies in particular if energy loss takes place in the region of the forming rails for the water extraction.

When pulp suspension, without preliminary draining, is introduced to the region of the leading forming roller, the water is spun off to achieve optimally graduated draining, thereby, increasing the pressure pulse upon the suspension between the screens, thus, improving the texture of the paper product. The pressure pulse upon the suspension is further enhanced by the action of the directly adjoining stationary forming element near the lower screen and the subsequent draining near the forming rail.

If the forming rails are arranged in the downstream half and in particular in the final third of the forming zone, impact of the vigorous driving stream with the forming rails behind the forming roller is prevented.

An essential advantage of the invention is that pulp suspension, which has not been subjected to preliminary draining, is fed to the converging twin screen and then is drained in the region where the twin screen wraps around the leading forming roller. Thus, a very vigorous driving stream is produced. If the pulp from the charging nozzle is applied in approximately the same direction as the spun off driving stream, a stronger driving stream results so that secondary streams, which are weak, in particular upon start up, are carried along. This means that in the region of the forming rails water is channelled along steadily.

The angle over which the twin screen contacts the forming roller is preferably 5° to 120° and, in particular, is approximately 20°. The angle over which the twin screen contacts the forming roller affects the strength of the driving stream. The thickness of the driving stream can be between 2 and 19 mm relative to a web speed of 300 to 2000 m/min, respectively. Given this relationship, normally, the driving stream is directly responsible for up to 40% of the amount of liquid that is drained solely through the upper screen.

Preferably, two or three, in particular three, forming rails are provided.

The forming rails can be inclined in the direction of the screen movement at an angle to the screen of 20° to 90°, which is about 37° in the illustrated embodiment. This affects the transition of secondary streams along the forming rails into the main driving stream.

Preferably, the forming rails are spaced less than 200 mm apart in order to achieve the best effect.

The water guide element can be arranged as the inner contour of an upper trough, rising near the leading forming roller, then proceeding substantially horizontally and thereafter falling to the end of the forming zone. This guide element is slightly curved as a whole so that the water streams make contact as a film flow due to centrifugal force.

In addition to careful draining, improvement is made to the texture (Egoutteur effect) without disadvantageously affecting water retention, pinholes or the L/Q ratio.

With screen speeds below 800 m/min, supplementary vacuum chambers can be provided.

The leading forming roller can be constructed to function also as a suction roller so that the slight draining pressure of the outer screen, occurring at high rotational speeds, can be compensated by vacuum.

DETAILED DESCRIPTION OF THE DRAWINGS

Figure 1:
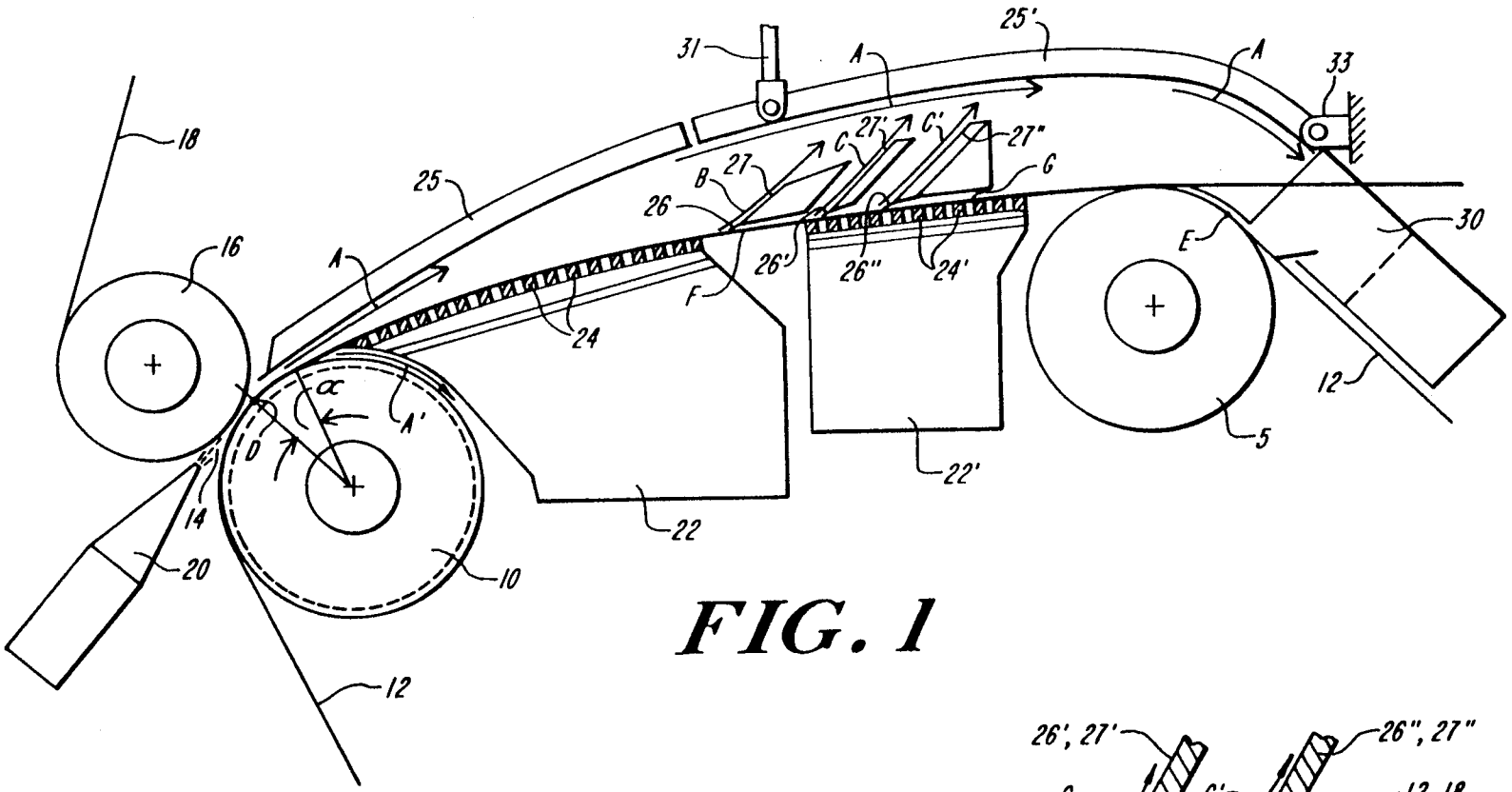
Figure 2:
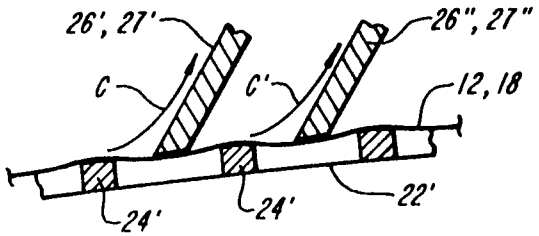

Numerous other objects, features and advantages of the invention should now become apparent upon a reading of the following detailed description taken in conjunction with the accompanying drawings, in which:

FIG. 1 is a side view of a twin screen paper forming apparatus as a part of a paper manufacturing machine; and FIG. 2 is a partial side view of the forming rails of the apparatus pressing on the upper screen.

DETAILED DESCRIPTION OF THE PREFERRED EMBODIMENT

On the left side of FIG. 1, a forming roller 10 is shown which is constructed as a so-called open forming roller. Chambers are formed in the periphery of roller 10. A lower screen 12 is driven over this forming roller to a pulp suspension charging gap 14, which is formed by the convergence of the lower screen 12, the forming roller 10, and the upper screen 18, which is driven by a deflection roller 16. Both screens 12 and 18 converge at a position D and thereafter form a twin screen the position D shall be termed "start" of the twin screen as used herein. A pulp suspension charging nozzle 20 is positioned upstream of charging gap 14.

In the illustrated embodiment, the twin screen overlays the circumference of the upstream half of the forming roller 10 through an angle $\alpha$ of between 5° and 120°. In the illustrated example, this angle is approximately 20°. The twin screen is fed around a rear forming roller 5 on the right side of FIG. 1. This rear forming roller 5 can operate as a suction roller or as a full roller and, in either alternative, may be grooved around its perimeter. The lower screen 12, which carries the fibre layer, diverges from the rear forming roller 5 at a position E. The area between positions D and E is termed a forming zone. Two forming shoes 22 and 22' are located below the lower screen 12. These forming shoes have evenly spaced lands 24 for supporting the lower screen.

Normally, the twin screen moves at a high speed. Since the pulp suspension discharged from the nozzle 20 contains, in addition to fibres and a filling material, up to 99% water, intense draining occurs in the area where the screens wrap around the leading forming roller 10, thus, producing a stream of liquid A having kinetic energy produced by the forming roller 10. This drive stream or jet A is spun off at an approximate tangent to the forming roller. Since the leading forming roller 10 is an open forming roller with peripheral chambers, a water stream A' is also formed peripherally and simultaneously diverts a portion of the water downwardly away from the pulp suspension.

The twin screen 12 and 18 wraps around the leading forming roller 10 and diverges tangentially from the roller to enter the forming zone at an angle of 0° to 50° relative to a horizontal plane. The extent to which the screens 12 and 18 wrap around the forming roller 10 substantially affects the force of and the amount of water comprising drive stream A. A drive stream thickness of 2 to 19 mm is attainable relative to a screen speed of 300 to 2000 m/min, respectively. As such, the drive stream comprises up to 40% of the total amount of liquid that is drained solely through the upper screen.

The drive stream A is directed by a water guide element consisting here of two sections 25 and 25' which surrounds the entire forming zone. From the forming roller 10 to the position E, the distance between the guide element and the twin screen increases. In the illustrated embodiment, the twin screen rises slightly in the forming zone, and the guide element rises and then falls in the stream A flow direction. Therefore, the apparatus retains a substantially horizontal cross section. From FIG. 1, it can be seen that the curved passage formed by the guide element is relatively flat. A plurality of guide sections could also be implemented to allow variation of the overall length of the guide element.

The section 25' of the guide element can pivot upward using a rod 31 about a bearing axis 33, thus, allowing access to the forming rail area for cleaning purposes.

In the second half F-E of the forming zone D-E, as represented in FIG. 1, downstream approximately from the zone's center, approximately in the zone's middle or last third, three forming rails 26, 26', 26'' are located. Two or more rails are generally necessary in this embodiment, but at least one rail should be utilized. These rails lie with their lower ends on the upper screen and, thus, in contact with the twin screen. The rails should preferably be located so that they are not opposite the lands 24. Guide surfaces 27, 27', 27'' abut the forming rails 26, 26' and 26'', respectively, and are positioned at an angle relative to the twin screen as depicted in FIG. 1. This angle lies in the range of 20° to 90° In this embodiment, the angle is 37°.

Each rail according to this embodiment should abut the screen at its lower end and extend to an upper end sloping, in this embodiment, in a downstream direction. The upper end of each rail should be spaced from the water guide so that respective secondary streams or jets of water (B, C, and C') formed by each of the rails, respectively can combine with the drive jet or stream A moving along the guide surface. As noted above, at least one rail having the above characteristics is contemplated according to this embodiment.

The drive stream A has sufficient kinetic energy to force secondary streams B, C and C' by the forming rails 26, 26' and 26''. The secondary streams B, C and C' are swept into the continuous drive stream A which flows along the water guide element surface by virtue of the kinetic energy imparted to the stream A by the forming roller. The continuous curved shape facilitates the drawing of the additional streams into the kinetic energy driven drive stream A. All streams are subsequently guided along the water element into a deflection trough 30.

The forming rails are placed downstream relatively far from the forming roller 10, e.g. the furthest downstream third G-E of the forming zone D-E, so that the drive stream A cannot impact directly on the rails. Such impact would disturb the flow conditions that otherwise allow careful and intensive draining near the rails. In this embodiment, if the number of forming rails is equal to or greater than two and they are spaced less than 200 mm apart then very good fibre texture formation and draining is achieved. Subsequent discharge of water extracted from the upper screen occurs at a location of minimum disturbance and also where more space is available.

In a preferred embodiment, the texture of the fillers is improved by locating forming rails B, C and C' on the upper screen where they press on the upper surface, thus, deflecting the twin screen. This deflection occurs either in the direct vicinity of a forming shoe or between the lands 24 of the forming shoes 22, 22'. The deflection can be as much as 10 mm, but in this embodiment, it is preferably 4 mm. In illustration, reference may be made to FIG. 2.

By guiding water onto the forming rails, a speed reduction occurs. Thus there is a speed difference between various streams relative to amount of water being drained and the distance between the main stream A and the secondary streams B, C, C'. The suction resulting from this speed reduction supplements the draining effect supplanting the need for applying an expensive vacuum to the screen for screen speeds in excess of approximately 800 m/min. Fundamentally, the kinetic energy of the main stream A is, thus, exploited to the extent that a difference in speed between this and the secondary streams exists.

It is important to note that in the forming region of the paper machine it is desired to achieve graduated effects on the twin screen in such manner that with increasing draining the size of the pressure pulse increases.

Having now described the present invention, it should now be apparent to those skilled in the art that the numerous other embodiments and modifications thereof are contemplated as falling within the scope of the present invention as described by the appended claims.

What is claimed is:

1. A twin screen paper forming apparatus comprising:

an upper screen and a lower screen moving in a first direction;

a leading forming roller positioned at the beginning of a forming zone where the upper and lower screen converge to form a twin screen and partially wrap around the leading forming roller;

at least one stationary forming element positioned downstream of the leading forming roller within the forming zone and in contact with the lower screen;

a water guide element having a guide surface and including a plurality of guide sections located approximately at the start of and extending over the forming zone;

means for varying positioning of said plurality of guide sections to alter a length of the guide surface;

two or more forming rails in the forming zone and in contact with an upper surface of the upper screen and having abutting guide surfaces spaced from said water guide element; and a pulp suspension discharge nozzle positioned to discharge upstream of the location where the upper and lower screens converge, to prevent preliminary draining.

2. In a twin-wire former having a pair of upper and lower flexible wire sieves forming a sandwich with a paper suspension therebetween, a forming roller and a forming section, means for moving said sandwich in a flow direction over said forming roller and then over said forming section, sad forming section being positioned with respect to said forming roller so that said sandwich changes direction over said forming roller thereby causing water in said sandwich to be thrown out of said sandwich with kinetic energy, means located in said forming section for removing additional water from said sandwich and a water collection box constructed and arranged for collecting said water and said additional water and a paper pulp suspension nozzle positioned at the start of said sandwich to direct paper pulp suspension to said sandwich, the improvement comprising:

water guide means positioned over and extending along said forming section, said water guide means having a first end positioned directly adjacent to said forming roller and a second end positioned adjacent to said collection box, said forming roller being positioned at the start of said sandwich and further positioned so as to contact the lower wire sieve, said water guide means having a relatively flat continuous curved shape so that said kinetic energy of water thrown out of said sandwich causes said water to flow along said water guide means in a continuous stream from said forming roller over said forming section and into said collection box, said continuous stream sweeping said additional water into said collection box; and said means for removing additional water comprising at least one forming rail located downstream of the forming roller and upstream of the collection box and contacting the upper wire sieve and at least one guide surface abutting the at least one forming rail, the at least one guide surface extending from the upper wire sieve to an end proximate the water guide means, the at least one guide surface defining a space between the end of the at least one guide surface being positioned so that said additional water forms at least one jet along the at least one guide surface that combines with said continuous stream flowing along said water guide means whereby the continuous stream is enhanced for improved dewatering.

3. The twin-wire former as set forth in claim 2 wherein said at least one forming rail and corresponding guide surface comprising a plurality of forming rails and corresponding guide surfaces positioned along the forming section for generating a plurality of jets of said additional water to converge with said continuous stream.

4. The twin-wire former as set forth in claim 3 further comprising at least one stationary forming element positioned downstream of said forming roller within said forming section and in contact with a lower side of said sandwich.

5. The twin-wire former as set forth in claim 4 wherein said forming element is shaped as a forming shoe with spaced lands arranged transversely of the direction of the sandwich motion.

6. The twin-wire former as set forth in claim 2 wherein said at least one forming rail presses on said sandwich.

7. The twin-wire former as set forth in claim 2 wherein said at least one forming rail presses on said sandwich with sufficient force to deflect said sandwich.

8. The twin-wire former as set forth in claim 2 wherein said sandwich wraps around said forming roller in an upstream half of said forming roller.

9. The twin-wire former as set forth in claim 3 further comprising a rear forming roller positioned beneath a lower side of the sandwich at a downstream end of said forming section.

10. The twin-wire former as set forth in claim 7 wherein said at least one forming rail is positioned to deflect said sandwich by up to 10 mm.

11. The twin-wire former as set forth in claim 10 wherein said at least one forming rail deflects said sandwich by approximately 4 mm.

12. The twin-wire former as set forth in claim 3 wherein the pair of sieves converge to form said sandwich at a point tangentially positioned along said forming roller that extends into said forming section of an angle between 0° and 50° relative to a horizontal plane thereto.

13. The twin-wire former as set forth in claim 2 wherein said at least one forming rail is positioned in the two downstream thirds of said forming section.

14. The twin-wire former as set forth in claim 2 wherein said at least one forming rail is positioned in the furthest downstream third of said forming section.

15. The twin-wire former as set forth in claim 3 wherein the sandwich contacts a circumference of said forming roller for an angle of between 5° and 120°.

16. The twin-wire former as set forth in claim 15 wherein said sandwich contacts a circumference of said forming roller for an angle of approximately 20°.

17. The twin-wire former as set forth in claim 2 wherein said at least one guide surface is inclined away from said sandwich in a downstream direction at an angle of between 20° and 90°.

18. The twin-wire former as set forth in claim 17 wherein said at least one guide surface is inclined away from said sandwich in a downstream direction at an angle of approximately 37°.

19. The twin-wire former as set forth in claim 2 wherein said at least one forming rail is spaced along said sandwich less than 200 mm apart.

20. The twin-wire former as set forth in claim 3 wherein said water guide element further comprises:

a first portion angled away from said sandwich in a downstream direction;

a second portion substantially horizontal to said sandwich; and a third portion angled toward said sandwich in a downstream direction.

21. The twin-wire former as set forth in claim 3 wherein said water guide element further comprises a plurality of guide sections, positions of which may be varied to alter an overall length of a surface of said guide element.

22. The twin-wire former as set forth in claim 21 wherein a guide section of said water guide element that covers said forming rails includes means for pivoting said guide section away from the overall water guide element.

23. The twin-wire former as set forth in claim 3 wherein said forming roller comprises a suction roller.

24. The twin-wire former as set forth in claim 3 wherein said forming roller includes chambers positioned upon a periphery thereof.

25. A twin-wire former comprising:

a pair of upper and lower flexible wire sieves forming a sandwich with a paper suspension therebetween;

a forming roller, positioned at the start of said sandwich and further positioned so as to contact the lower wire sieve;

a forming section;

a paper pulp suspension nozzle positioned at the start of said sandwich for providing paper pulp suspension to said sandwich;

means for moving said sandwich in a flow direction over said forming roller and then over said forming section, said forming section being positioned with respect to said forming roller so that said sandwich changes direction over said forming roller thereby causing water in said sandwich to be thrown out of said sandwich with kinetic energy;

means located in said forming section for removing additional water from said sandwich;

a water collection box constructed and arranged for collecting said water and said additional water;

water guide means positioned over and extending along said forming section, said water guide means having a first end positioned directly adjacent to said forming roller and a second end positioned adjacent to said collection box, said water guide means having a relatively flat continuous curved shape so that said kinetic energy of water thrown out of said sandwich causes said water to flow along said water guide means in a continuous stream from said forming roller over said forming section and into said collection box, said continuous stream sweeping said additional water into said collection box; and said means for removing additional water comprising at least one forming rail located downstream of the forming roller and upstream of the collection box and contacting the upper wire sieve and at least one guide surface extending from the upper wire sieve to an end at a position thereabove, the end defining a space between said at least one guide surface and said water guide means, said at least one forming rail and said water guide means being positioned so that said additional water forms at least one jet that combines with said continuous stream to enhance said continuous stream for improved dewatering.

26. The twin-wire former as set forth in claim 25 wherein said at least one forming rail and corresponding guide surface comprises a plurality of forming rails and corresponding guide surfaces positioned along the forming section for generating a plurality of jets of said additional water to converge with said continuous stream.

27. The twin-wire former as set forth in claim 26 wherein said forming rails are positioned to deflect said sandwich to generate dewatering pressure pulses for forming said jets.

* * * * *